United States Patent [19]

Opprecht et al.

[11] Patent Number: 4,795,295

[45] Date of Patent: Jan. 3, 1989

[54] RUPTURABLE CAN MEMBER AS WELL AS METHOD AND APPARATUS FOR ITS PRODUCTION

[75] Inventors: Paul Opprecht, Bergdietikon; Werner Urech, Kaiserstuhl, both of Switzerland

[73] Assignee: Elpatronic AG, Switzerland

[21] Appl. No.: 110,533

[22] Filed: Oct. 16, 1987

Related U.S. Application Data

[60] Continuation of Ser. No. 896,610, Aug. 14, 1986, abandoned, which is a division of Ser. No. 779,885, Sep. 25, 1985, Pat. No. 4,662,534.

[30] Foreign Application Priority Data

Sep. 25, 1984 [CH] Switzerland ..... 4582/84

[51] Int. Cl.[4] ..... B21D 51/26

[52] U.S. Cl. ..... 413/1; 413/54; 413/69; 220/274

[58] Field of Search ..... 413/4, 14, 15, 54, 55, 413/12, 16, 17, 66, 67, 68, 70–77, 12, 69, 1; 219/64, 79, 80; 198/624; 29/121.6; 220/274, 276

[56] References Cited

U.S. PATENT DOCUMENTS

| | | | |
|---|---|---|---|
| 1,924,472 | 8/1933 | Thomson | 156/204 |
| 2,187,740 | 1/1940 | Hothersall | 219/64 |
| 2,315,535 | 4/1943 | McCann | 413/72 |
| 2,353,728 | 7/1944 | Hubbell | 219/64 |
| 2,753,075 | 7/1956 | Geertsen | 220/274 |
| 2,806,628 | 9/1957 | Morrill et al. | 220/274 |
| 2,965,263 | 12/1960 | Haidegger | 198/624 |
| 4,160,892 | 7/1979 | Opprecht et al. | 219/83 |

FOREIGN PATENT DOCUMENTS

| | | | |
|---|---|---|---|
| 148752 | 6/1981 | Fed. Rep. of Germany | 198/624 |

*Primary Examiner*—Robert P. Olszewski
*Assistant Examiner*—Robert Showalter
*Attorney, Agent, or Firm*—McCormick, Paulding & Huber

[57] ABSTRACT

A rupturable can member (10) of sheet metal has a pair of scorings (16) which define a tearing strip (18) laterally. Welded onto the tearing strip (18) is a tongue (20) which has a thickened portion (24) at its welded-on end (22). This thickened portion is formed by a margin folded back towards the other free end (26) of the tongue (20).

4 Claims, 3 Drawing Sheets

RUPTURABLE CAN MEMBER AS WELL AS METHOD AND APPARATUS FOR ITS PRODUCTION

Figure 1:
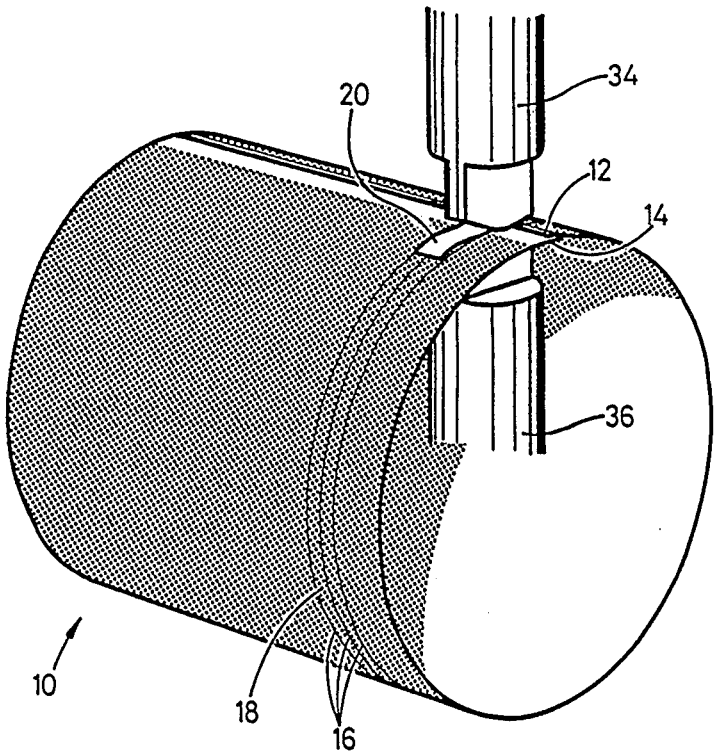

This is a continuation of co-pending application Ser. No. 896,610 filed on Aug. 14, 1986, now abandoned, which is a division of co-pending application Ser. No. 779,885 filed on Sept. 25, 1985, now U.S. Pat. No. 4,662,534.

The invention relates to a rupturable can member of sheet metal having a pair of scorings which define a tearing strip laterally and a tongue which, as a separate sheet-metal member, is welded by one of its ends to the tearing strip and extends in the longitudinal direction thereof.

In a known can member (DE-C 1 017 042), the tongue is stamped out in one piece together with a sheet-metal blank which is plane in the initial state and in the plane of which the tongue extends beyond one of two longitudinal edges of the sheet-metal blank. A starting scoring, which connects the scorings to one another, is stamped into the sheet-metal blank in the region of the other longitudinal edge together with the two scorings which define the tearing strip laterally. The sheetmetal blank is then rolled up in such a manner that the two longitudinal edges overlap one another and these are then welded to one another to form a longitudinal seam so that a cylindrical can body results Finally, a complete can is produced from this in that the two ends of the can body are closed by beading to a cover and a bottom respectively. In order to open the can, a key is placed on the tongue and is rolled on the nearest beaded edge.

With these known cans, inexperienced users in particular do not always succeed in removing the tearing strip completely in the desired manner at the first attempt. Not infrequently, the tearing strip tears off already in the region of the longitudinal edges or shortly behind them because converging cracks form which originate from the tongue and meet between the circumferential scorings The user is then forced to continue the opening of the can with a tool which is not provided for this purpose in which case there is a danger of him injuring himself on sharp sheet-metal edges.

With the intention of making the opening operation more reliable, a can body was proposed in an earlier Application wherein the tongue, as a separate sheet-metal member, is welded by one of its ends to the tearing strip in the region of the outer longitudinal edge. In this case, a starting scoring should preferably be provided between the circumferential scorings, in the region of the inner longitudinal edge of the can body. Nevertheless, it has proved very difficult, in the short cycle times of fractions of a second which have to be adhered to in industrial can production, to weld the tongue so precisely onto the outer longitudinal edge and with such a precisely measured welding current that the opening operation is facilitated in the intended manner but the quality of the longitudinal seam is not reduced It is therefore the object of the invention to develop further a can member of the type described at the beginning, particularly a can body with longitudinal edges which are welded to one another or are going to be welded to one another, in such a manner that the opening operation is facilitated without the production or further processing of the can member being made more difficult or the durability of the can being reduced before it is deliberately opened.

According to the invention, the problem is solved in that the tongue comprises, at its welded-on end, a margin which is folded back in the direction of its other, free end.

As a result, tongue and tearing strip are given considerably greater rigidity in the region in which they are welded to one another than can be achieved by the welding on of an unfolded tongue hitherto proposed. The tongue folded back according to the invention and welded at its folded-back margin can be rolled up with a key just as easily as a conventional tongue of the same width and thickness of sheet metal. As soon as the roll formed during the rolling up of the tongue reaches the portion stiffened by the folded over and welded margin, however, a starting crack forms in the tearing strip which crack reaches the two scorings quickly and reliably and then follows these.

The invention is particularly suitable for use on a can member with two longitudinal edges which are welded to one another or are going to be welded to one another in an overlapping manner. In this case, the tongue is preferably welded on outside or remote from the overlapping region of the longitudinal edges As a result, any influence of the tongue welding on the longitudinal seam welding is avoided. It has been found that the tongue according to the invention can be welded on at any desired point of the tearing strip and no starting scoring is necessary; the positioning of the tongue in relation to the can member to which it is to be welded is therefore possible with simple means and little expenditure of time.

It is particularly advantageous if the margin of the tongue is folded over outwards, away from the sheet metal of the can member. With this arrangement of the folded-over margin, the tongue according to the invention can bear against the sheet metal of the can member as smoothly as an unfolded tongue so that the tongue does not project from the can member or at least does not do so in a disturbing manner and, in addition, the risk of an accidental perforation resulting from a blow on the tongue is kept extremely low When the tongue is rolled up with a key in the intended manner, however, and the resulting roll reaches the folded back edge, a particularly strong concentration of force results in the tearing strip below this edge and facilitates considerably the required formation of a starting crack.

The intended initial tearing can be still further facilitated as a result of the fact that the folded back margin ends in a marginal edge from which at least one portion extends obliquely to the circumferential scorings. It is an advantage if the folded back margin is arrow-shaped In particular, the folded back margin may appropriately be rectangular in shape with an equilateral triangle following thereon, the sides of which form the marginal edge.

At its side remote from the folded back margin, the tongue preferably has a zone prepared for the welding on, with a fluted or waffle-like surface structure. This zone preferably has a shape corresponding to the folded back margin, particularly the shape of an arrow pointing towards the free end of the tongue.

Can members according to the invention can be produced by a method wherein a plane sheet-metal blank provided with scorings is rolled up in known manner to form a cylinder with overlapping longitudinal edges, which are subsequently welded to one another. According to the invention, this method is further developed in that the tongue is welded onto the tearing strip and the sheet-metal blank is only then rolled up.

In order to carry out this method, an apparatus may appropriately be used which is provided with a plurality of rollers for rolling up the sheet-metal blanks and which is further developed according to the invention, in that those rollers which are adapted to act on the side of the sheet-metal blank provided as the outside of the cylinder each comprise an annular groove, the width and depth of which are somewhat greater than the width and thickness of the welded-on tongue together with its folded back margin.

Figure 2A:
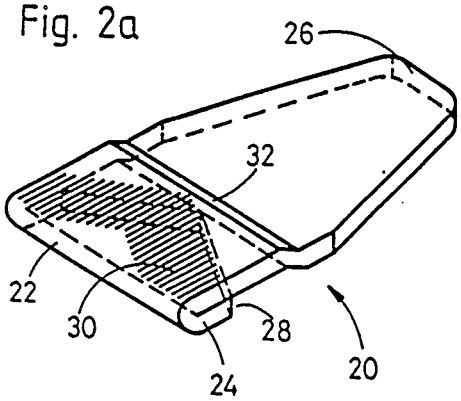
Figure 2B:
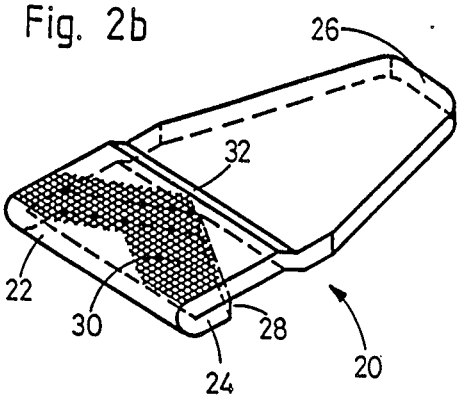
Figure 2C:
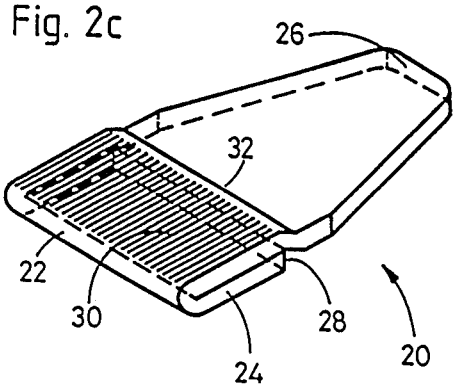
Figure 2D:
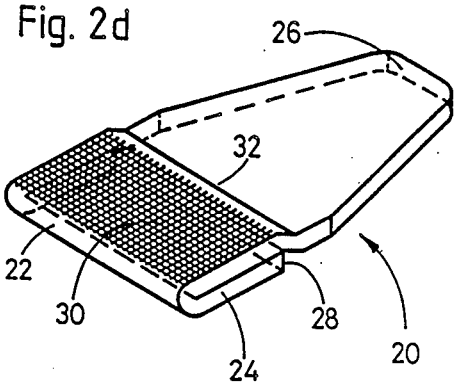
Figure 2E:
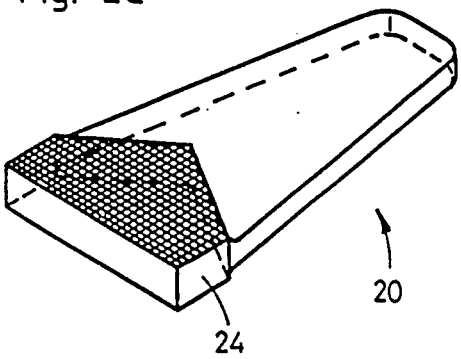
Figure 2F:
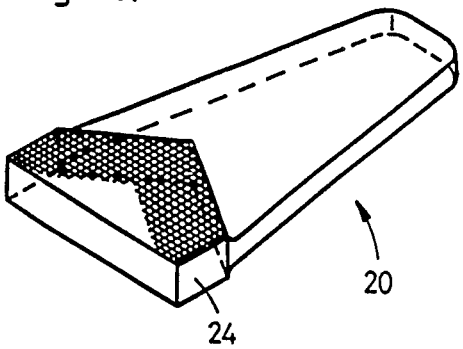
Figure 3:
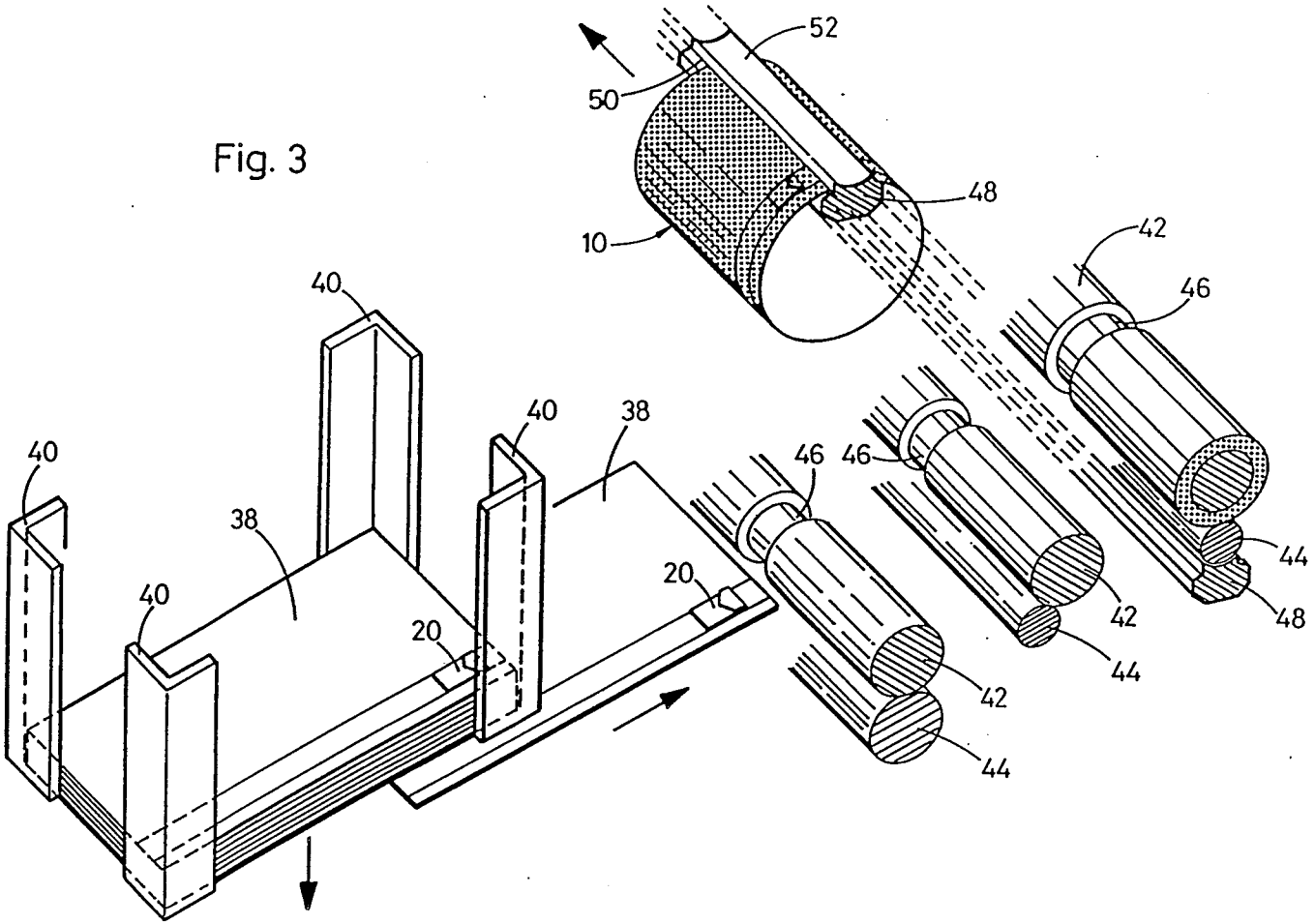

Examples of embodiment of the invention are explained below, with further details, with reference to diagrammatic drawings They show, each in an oblique view:

FIG. 1 an openable can member with welded-on tongue,

FIGS. 2*a*–2*f* various forms of embodiment of the tongue before it is welded on, and FIG. 3 an apparatus for rolling up can members as shown in FIG. 1.

In FIG. 1, a cylindrical can member 10 is illustrated which consists, for example, of tin plate with a thickness of 0.2 mm. The can member 10 has an outer longitudinal edge 12 and an inner longitudinal edge 14 as well as a pair of outer scorings 16 running in the circumferential direction, which extend at right angles to the longitudinal edges and define a tearing strip 18 between them. The tearing strip 18 may comprise one or more further scorings running parallel to the scorings 16 Welded onto the tearing strip 18 is an elongated tongue 20 which consists, for example, of tin plate with a thickness of 0.4 mm and extends in the longitudinal direction of the tearing strip 18 without reaching one of the longitudinal edges 12 or 14 of the can member 10.

The tongue 20, a plurality of modifications of which are illustrated in detail in FIGS. 2*a*–2*d*, is only welded on in the region of one end 22 which is at a distance from the inner longitudinal edge 14 substantially corresponding to the width of the tearing strip 18. The end 22 which is welded on or is to be welded on comprises a margin 24 which is folded back outwards, away from the can member 10 and which extends in the direction of the other end 26 which is still free after the tongue 20 has been welded on. The free end 26 is narrowed trapezoidally in order to facilitate the slipping on of an ordinary commercial key to open the can member 10.

In all the examples illustrated in FIGS. 2*a*–2*d*, the folded back margin 24 of the tongue 20 has a rectangular region in which in FIGS. 2*a* and 2*b* only occupies a portion of the length of the folded back margin 24 but in FIGS. 2*c* and 2 occupies the whole length thereof. According to FIGS. 2*a* and 2*b*, the rectangular region is followed by a triangular region so that the folded back margin 24 is arrow-shaped as a whole. In any case, the folded back margin 24 ends with an outer marginal edge 28, seen from the can member 10, which edge points towards the free end 26 in the form of an arrow according to FIGS. 2*a* and 2*b* but extends transversely to the scorings 16 according to FIGS. 2*c* and 2*d*.

In all the modifications illustrated, the tongue 20 has, at its side remote from the folded-back margin 24, a zone 30 which is adapted for welding onto the tearing strip 18 and which has a surface structure which is fluted according to FIGS. 2*a* and 2*c* but is preferably waffled as shown in FIGS. 2*b* and 2*d* so that it consists of a multiplicity of small pyramid-shaped projections. Such a surface structure is intended to improve the passage of current and to avoid spattering of tin if the tongue 20 is welded onto the tearing strip 18 by an electrical resistance spot-welding process. The portion of the tongue 20 which is intended to receive a key and which becomes narrower towards the free end 26 is offset in relation to the zone 30 by a small shoulder 32

According to FIG. 1, the tongue 20 is welded onto the tearing strip 18 by means of two welding electrodes 34 and 36, only after the two longitudinal edges 12 and 14 have already been welded to one another with an overlap in the usual manner.

In FIG. 3, on the other hand, a stack of plain, rectangular sheet-metal blanks 38 is illustrated, each with a welded-on tongue 20. The stack is guided between vertical guides 40 which release only the bottom sheet-metal blank 38 each time so that this can be conveyed away from the stack and introduced between rollers 42 and 44 which are disposed in pairs and which roll up a cylindrical can member 10 out of each plane sheet-metal blank 38. In each pair of rollers, that roller 42 which acts on the outside of the cylindrical can member 10 being formed, has an annular groove 46 which is so disposed and dimensioned that it allows the tongue 20 to run through unhindered and without jerks.

A rail 48 begins at the last pair of rollers 42, 44 illustrated, around which rail each sheet-metal blank 38 is rolled and along which it is then moved on axially as a cylindrical can member 10. The rail 48 has guide edges 50 and 52 which guide the longitudinal edges 12 and 14 of the can member 10 in such a manner that they approach one another and finally overlap so as to form a lap seam by electrical resistance seam ((i.e.) compressed or meshed seam) welding; for this, reference is made to the U.S. Pat. No. 4,160,892 for example A modification of the tongue 20 which is particularly advantageous from the constructional and production point of view is illustrated in FIG. 2*e*. In this tongue, the folding back of the margin is eliminated because here the starting point is a thicker basic sheet and the appropriate reductions are stamped out by rolling or coining leaving only the required thickened portion 24. The honeycomb or waffle pattern is then again provided on this thickened portion in the arrow-shape as indicated in FIGS. 2*a* and 2*b*. As a result of these operations, the relatively labour-intensive manipulation of the folding back of the free end can then be eliminated and in addition a considerable hardening of the basic material is achieved by the pressing work, that is to say the tongue is now considerably harder than if it were stamped out of a normal sheet-metal strip.

We claim:

1. A method of producing a rupturable can member comprising the steps of rolling up a plain sheet-metal blank (3) provided with scorings (16) defining a tearing strip to form a cylinder with overlapping longitudinal edges (12,14) and subsequently welding the longitudinal edges of the blank to one another to form the can member, characterized by the steps of: providing a tongue with a thickened portion and a thin portion, welding said tongue (20) through said thickened portion onto the tearing strip (18) at a position wholly within said tearing strip with said thickened portion adjacent to one of said longitudinal edges and remote from the edges to be overlapped prior to the steps of rolling up and welding the blank, the remote position of the tongue from the edges being selected to avoid having the tongue interfere with the step of welding the longitudinal edges to one another.

2. A method of producing a rupturable can member comprising the steps of rolling up a plain sheet-metal blank (3) provided with scorings (16) defining a tearing strip to form a cylinder with longitudinal edges (12,14) having a limited overlap and subsequently compressed seam welding the longitudinal edges of the blank to one another to form the can member, characterized by the steps of: providing a tongue with a thickened portion and a thin portion, welding said tongue (20) with said thickened portion adjacent to one of said longitudinal edges through said thickened portion onto the tearing strip (18) at a position remote from the edges to be overlapped prior to the steps of rolling up and welding the blank, the remote position of the tongue from the edges being selected to avoid having the tongue interfere with the step of welding the longitudinal edges to one another.

3. A method of producing a rupturable can member comprising the steps of rolling up a plain sheet-metal blank (3) provided with scorings (16) defining a tearing strip to form a cylinder with longitudinal edges (12,14) having a limited overlap and subsequently compressed seam welding the longitudinal edges of the blank to one another to form the can member, characterized by the steps of: providing an elongated tongue with a thickened portion and an opposed thin portion, welding said tongue (20) through said thickened portion onto the tearing strip (18) at a position remote from the edges to be overlapped with said thickened portion positioned adjacent to one of said longitudinal edges prior to the steps of rolling up and welding the blank, the remote position of the tongue from the edges being selected to avoid having the tongue interfere with the step of welding the longitudinal edges to one another.

4. A method of producing a rupturable can member comprising the sequential steps of:

scoring a planar sheet metal blank having longitudinal edges to define a score strip;

welding a tongue with a thickened portion and a thin portion to said sheet metal blank within said strip with said thickened portion disposed towards one of said longitudinal edges at a remote position therefrom;

forming a cylinder with said longitudinal edges having a limited overlap;

compressed seam welding said longitudinal edges to one another to form a can member;

said remote tongue positioned selected to avoid having said tongue interfere with the step of compressed seam welding of said longitudinal edges.

* * * * *